US010356501B2

(12) United States Patent
Hattori et al.

(10) Patent No.: US 10,356,501 B2
(45) Date of Patent: Jul. 16, 2019

(54) CONNECTION CABLE, MICROPHONE, AND SIGNAL PROCESSING SYSTEM

(71) Applicant: YAMAHA CORPORATION, Hamamatsu-shi (JP)

(72) Inventors: Atsushi Hattori, Hamamatsu (JP); Yutaka Ikuma, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/000,995

(22) Filed: Jun. 6, 2018

(65) Prior Publication Data

US 2018/0288512 A1 Oct. 4, 2018

Related U.S. Application Data

(63) Continuation of application No. PCT/JP2017/007606, filed on Feb. 28, 2017.

(30) Foreign Application Priority Data

Feb. 29, 2016 (JP) ..... 2016-037072

(51) Int. Cl.
*H04R 1/04* (2006.01)
*H04R 3/00* (2006.01)
(Continued)

(52) U.S. Cl.
CPC ..... *H04R 1/04* (2013.01); *H01R 31/065* (2013.01); *H04R 3/00* (2013.01); *H04R 3/005* (2013.01);
(Continued)

(58) Field of Classification Search
CPC ..... H01R 24/84; H01R 1/04; H01R 3/00; H01B 7/00
(Continued)

(56) References Cited

U.S. PATENT DOCUMENTS 5,902,153 A * 5/1999 Weickenmeier ..... H01R 9/2491 439/620.09
2011/0317845 A1* 12/2011 Yuan ..... A61F 11/06 381/73.1
(Continued)

FOREIGN PATENT DOCUMENTS

JP S4823989 U 3/1973
JP 49-37181 * 4/1974
(Continued)

OTHER PUBLICATIONS

International Search Report issued in Intl. Appln. No. PCT/JP2017/007606 dated May 23, 2017. English translation provided.
(Continued)

*Primary Examiner* — Melur Ramakrishnaiah
(74) *Attorney, Agent, or Firm* — Rossi, Kimms & McDowell LLP

(57) ABSTRACT

A connection cable is provided with a plurality of structures, a first connector, and a second connector. The plurality of structures include a concave-shaped structure and a convex-shaped structure. The first connector includes the concave-shaped structure and the convex-shaped structure that are arranged in line symmetry with respect to a predetermined reference line. The second connector includes the concave-shaped structure and the convex-shaped structure that are arranged in line symmetry with respect to a predetermined reference line.

18 Claims, 12 Drawing Sheets

(51) Int. Cl.

| | |
|---|---|
| ***H04R 29/00*** | (2006.01) |
| ***H01R 31/06*** | (2006.01) |
| *H01R 24/84* | (2011.01) |
| *H01R 13/24* | (2006.01) |
| *H01R 13/64* | (2006.01) |
| *H01R 107/00* | (2006.01) |

(52) U.S. Cl.
CPC ..... *H04R 29/004* (2013.01); *H01R 13/2421* (2013.01); *H01R 13/64* (2013.01); *H01R 24/84* (2013.01); *H01R 2107/00* (2013.01); *H01R 2201/00* (2013.01)

(58) Field of Classification Search
USPC ..... 381/66, 384, 74, 123, 334, 370; 439/284
See application file for complete search history.

(56) References Cited

U.S. PATENT DOCUMENTS

| | | | | |
|---|---|---|---|---|
| 2013/0163411 | A1 | 6/2013 | Lylon et al. | |
| 2014/0270837 | A1* | 9/2014 | Okumura ..... | G03G 21/1652 399/90 |
| 2015/0079829 | A1 | 3/2015 | Brodsgaard | |
| 2015/0349457 | A1* | 12/2015 | Shariff ..... | H01R 24/20 439/37 |
| 2016/0028896 | A1* | 1/2016 | Schellekens ..... | H04R 3/005 370/260 |

FOREIGN PATENT DOCUMENTS

| | | | | |
|---|---|---|---|---|
| JP | S4937181 | A | | 4/1974 |
| JP | 2000078590 | A | * | 3/2000 |
| JP | 2002078590 | A | * | 3/2002 |
| JP | 2002078590 | A | | 3/2002 |
| JP | 2003339037 | A | | 11/2003 |
| JP | 2013541878 | A | | 11/2013 |
| WO | 2014139589 | A1 | | 9/2014 |

OTHER PUBLICATIONS

Written Opinion issued in Intl. Appln. No. PCT/JP2017/007606 dated May 23, 2017.

* cited by examiner

CONNECTION CABLE, MICROPHONE, AND SIGNAL PROCESSING SYSTEM

CROSS REFERENCE TO RELATED APPLICATIONS

The present application is a continuation application of International Patent Application No. PCT/JP2017/007606, filed on Feb. 28, 2017, which claims priority to Japanese Patent Application No. 2016-037072, filed on Feb. 29, 2016. The contents of these applications are incorporated herein by reference in their entirety.

BACKGROUND OF THE INVENTION

1. Field of the Invention

A preferred embodiment according to the present invention relates to a connection cable for connecting units.

2. Description of the Related Art

Conventionally, as a mode of connecting units, daisy chain connection as disclosed in Japanese Unexamined Patent Application Publication (Translation of PCT Application) No. 2013-541878, for example, has been known. Each of the units of the daisy chain connection disclosed in Japanese Unexamined Patent Application Publication (Translation of PCT Application) No. 2013-541878 includes an input port and an output port.

A signal is transmitted between units in one direction and a user needs to connect the units in consideration of the direction of a connection cable. As the number of units increases, the connection becomes more complicated.

SUMMARY OF THE INVENTION

A preferred embodiment of the present invention is directed to provide a connection cable with which a user does not have to be conscious of the direction of connection between units.

A connection cable is provided with a plurality of structures, a first connector, and a second connector. The plurality of structures include a concave-shaped structure and a convex-shaped structure. The first connector includes the concave-shaped structure and the convex-shaped structure that are arranged in line symmetry with respect to a predetermined reference line. The second connector includes the concave-shaped structure and the convex-shaped structure that are arranged in line symmetry with respect to a predetermined reference line.

According to a preferred embodiment of the present invention, a connection cable with which a user does not have to be conscious of the direction of connection between units is able to be achieved.

The above and other elements, features, characteristics, and advantages of the present invention will become more apparent from the following detailed description of the preferred embodiments with reference to the attached drawings.

DETAILED DESCRIPTION OF THE PREFERRED EMBODIMENTS

A connection cable according to a present preferred embodiment is provided with a plurality of structures, a first connector, and a second connector. The plurality of structures include a concave-shaped structure and a convex-shaped structure. The first connector includes the concave-shaped structure and the convex-shaped structure that are arranged in line symmetry with respect to a predetermined reference line. The second connector includes the concave-shaped structure and the convex-shaped structure that are arranged in line symmetry with respect to a predetermined reference line.

Figure 8A:
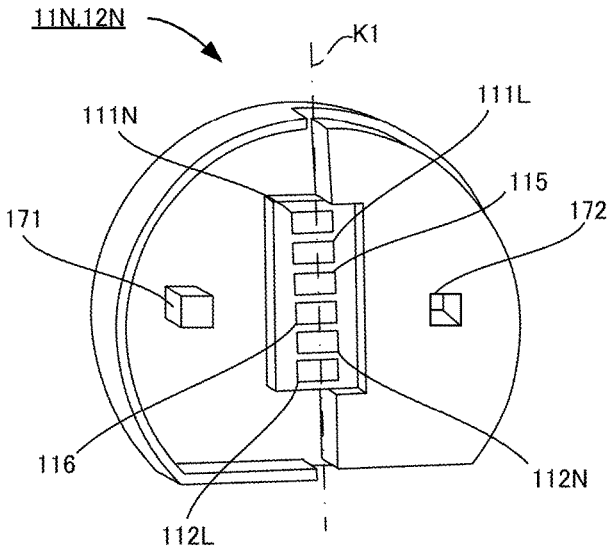
FIG. 8A is a diagram showing a structure of a connector according to a third modification example.

Such a connection cable, as shown in a first connector 11N and a second connector 12N of FIG. 8A, for example, include signal terminals 111L, 111N, 112L, and 112N, a power terminal 116, and a ground terminal 115 that are arranged on a predetermined reference line K1. In such a connection cable, a convex-shaped structure (a protrusion) 171 and a concave-shaped structure (a depression to which the projection is inserted) 172 are arranged with respect to the predetermined reference line K1. In such a case, since the first connector 11N and the second connector 12N are also in line symmetry across the predetermined reference line K1, the direction of connection does not have to be considered.

It is to be noted that Japanese Unexamined Patent Application Publication (Translation of PCT Application) No. 2013-541878, for example, proposes a method of allocating each of two ports to either an input port or an output port and switching wiring on a circuit in a unit, which means that the method of Japanese Unexamined Patent Application Publication (Translation of PCT Application) No. 2013-541878 needs to construct a system in which the wiring is switched by software or hardware. In addition, the method of Japanese Unexamined Patent Application Publication (Translation of PCT Application) No. 2013-541878 also needs to assign either an input port or an output port every time a connection cable is removed.

In contrast, in a case in which a connection cable is provided with a plurality of signal terminals and a pair of signal terminals that are connected by the same signal line is arranged at positions different from each other in the first connector and the second connector, even when the number of units increases, a user does not have to be conscious of whether a port is an input port or an output without using the system of switching an input port and an output port.

It is to be noted that, in the connection cable, the structure itself may be a signal terminal. In such a case, a convex-shaped structure serves as a male terminal, and a concave-shaped structure serves as a female terminal.

It is to be noted that a power wire (a power terminal) and a ground wire (a ground terminal) may be arranged on the predetermined reference line or may be arranged in line symmetry with respect to the predetermined reference line.

Figure 1A:
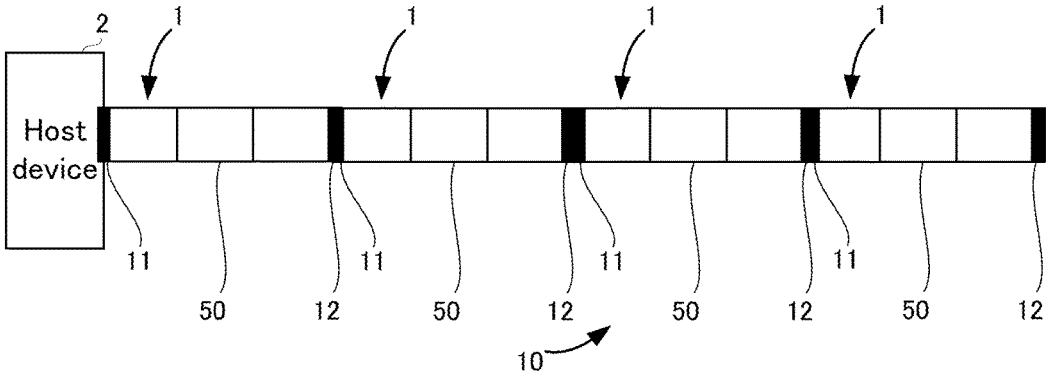
FIG. 1A is a block diagram of a signal processing system.
Figure 1B:
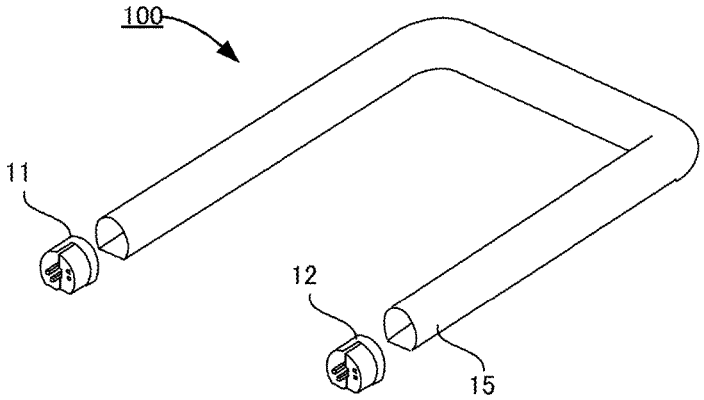
FIG. 1B is a diagram showing a structure of a connection cable.

FIG. 1A is a connection conceptual diagram (a block diagram) of a signal processing system 10, and FIG. 1B is an exploded perspective view showing a structure of a microphone built-in type connection cable (a microphone) 1.

The signal processing system 10 is provided with a host device 2 and a plurality of microphone built-in type connection cables 1 (hereinafter simply referred to as a connection cable). In this example, the signal processing system 10 is provided with four connection cables 1 (see FIG. 3).

Figure 1C:
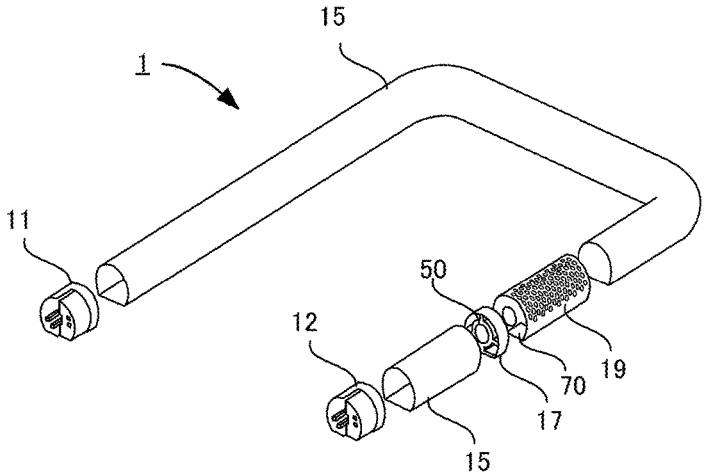
FIG. 1C is a diagram showing a structure of a microphone built-in type connection cable.

The connection cable 1, as shown in FIG. 1B, is provided with a connection cable 100 including: a cable body 15 having flexibility; and a first connector 11 and a second connector 12 that are respectively arranged at both ends of the cable body 15. In addition, the connection cable 1, as shown in FIG. 1C, is further provided with a microphone holder 17 arranged in the middle of the cable body 15, and a grill 19.

The cable body 15 has a substantially circular section and a hollow structure. Various types of wiring such as a power wire, a ground wire, and a signal line is configured to pass through a hollow portion in the cable body 15. The cable body 15 has a lateral surface of which a portion is flat so as not to roll easily even when placed on a flat surface such as the surface on a desk. It is to be noted that the cross-sectional shape of the cable body 15 is not limited to this example. For example, the cross-sectional shape may be a triangle. In addition, the flexibility of the cable body 15 is not an essential element in the present invention.

The microphone holder 17 has the same cross-sectional shape as the cable body 15. The microphone holder 17 is made of a rigid material such as resin or metal, and holds a microphone unit 50 being a sound pickup portion. The microphone unit 50 is held in the center, when viewed in a plan view of the cross-section of the microphone holder 17. The microphone holder 17 is connected to the grill 19. The microphone holder 17 also has a hollow structure through which the wiring passes.

The grill 19 has the same cross-sectional shape as the cable body 15. The grill 19 is made of a rigid material such as resin or metal. The grill 19 has a lateral surface on which a large number of holes are provided and which is acoustically opened. The microphone unit 50 picks up ambient sound from the holes of the grill 19, and generates a sound pickup signal. The sound pickup signal is transmitted to the host device 2.

In addition, the grill 19 inside has a flat portion at which a base plate 70 on which the DSP or the like are mounted is arranged.

The first connector 11 and the second connector 12 are physical interfaces to be respectively connected to another connection cable 1 or the host device 2. The first connector 11 and the second connector 12 have the same shape.

Figure 2A:
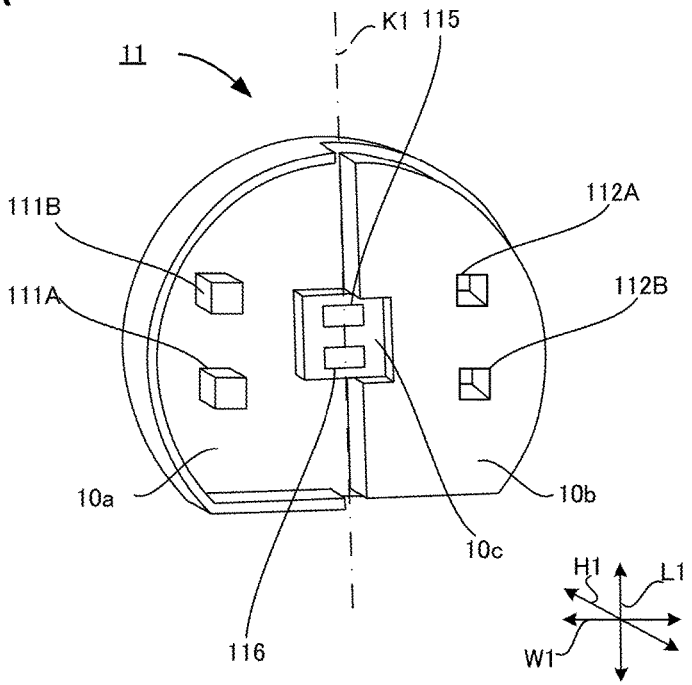
FIG. 2A is a diagram showing a structure of a connector.
Figure 2B:
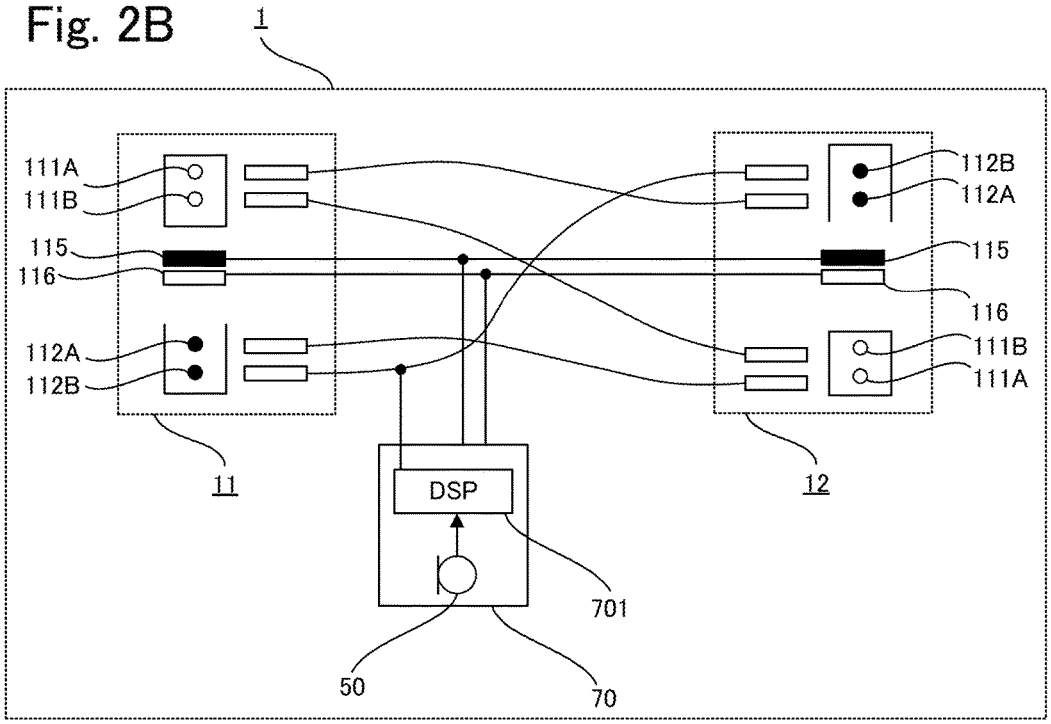
FIG. 2B is an internal wiring diagram and a configuration block diagram.

FIG. 2A is a diagram showing a structure of a connector, and FIG. 2B is an internal wiring diagram and configuration block diagram of the connection cable 1.

It is to be noted that, since the first connector 11 and the second connector 12 have the same structure, the first connector 11 will be described as a representative.

The first connector 11 is provided with a ground terminal 115, a power terminal 116, a male terminal 111A, a male terminal 111B, a female terminal 112A, and a female terminal 112B. The male terminal 111A and the male terminal 111B, as described above, are convex-shaped structures. In addition, the female terminal 112A and the female terminal 112B, as described above, are concave-shaped structures. Further, the male terminal 111A is formed so as to be inserted to the female terminal 112B. Moreover, the male terminal 111B is formed so as to be inserted to the female terminal 112A.

The male terminal 111A, the male terminal 111B, the female terminal 112A, and the female terminal 112B are signal terminals. The sound pickup signal that has been generated by the microphone unit 50 is transmitted to another connection cable 1 or the host device 2 through the male terminal 111A, the male terminal 111B, the female terminal 112A, or the female terminal 112B.

The ground terminal 115 and the power terminal 116 are arranged on the center line (the predetermined reference line K1) indicated by a dashed dotted line in FIG. 2A. The predetermined reference line K1 is a line passing the center in a direction in parallel with the length direction L1, the direction being in the width direction W1 of the first connector 11 in a plan view of the first connector 11. The ground terminal 115 and the power terminal 116 are each bilaterally symmetrical in a plan view of the bottom surface 10*a* or bottom surface 10*b* of the first connector 11. In other words, each of the ground terminal 115 and the power terminal 116 is formed in line symmetry with respect to the predetermined reference line K1.

The male terminal 111A and the male terminal 111B are arranged on a first side (the left side, for example) of the predetermined reference line K1 in a plan view of the bottom surface 10*a* or bottom surface 10*b* of the first connector 11. The female terminal 112A and the female terminal 112B are arranged on a second side (the right side, for example) of the predetermined reference line K1 in a plan view of the bottom surface 10*a* or bottom surface 10*b* of the first connector 11. The male terminal 111A and the male terminal 111B are respectively arranged bilaterally symmetrical to the female terminal 112A and the female terminal 112B across the predetermined reference line K1. More specifically, the male terminal 111A is arranged bilaterally symmetrical to the female terminal 112B. In addition, the male terminal 111B is arranged bilaterally symmetrical to the female terminal 112A.

The right side of the first connector 11 is relatively higher by the same distance as the depth of the concave shape of the female terminal 112A and the female terminal 112B. The left side of the first connector 11 is relatively lower by the same distance as the height of the convex shape of the male terminal 111A and the male terminal 111B. Specifically, in the connection cable 1 of the present preferred embodiment, the height of the bottom surface 10*a* is different from the height of the bottom surface 10*b* in the height direction H1. More specifically, the bottom surface 10*a* is formed lower than bottom surface 10*b*, and the height of the male terminal 111A and the male terminal 111B is formed so as to be the same as the depth of the concave shape of the female terminal 112A and the female terminal 112B. In other words, in the height direction H1, the height of the male terminal 111A and the male terminal 111B is the same as the height from the bottom surface 10*a* to the bottom face 10*b*. Furthermore, in other words, the end surface of each of the male terminal 111A and the male terminal 111B and the bottom surface 10*b* are on the same plane.

A member 10*c* around a portion in which the ground terminal 115 and the power terminal 116 are arranged is relatively higher than the left side of the first connector 11 by half of the height of the convex shape of the male terminal 111A and the male terminal 111B.

Figure 4A:
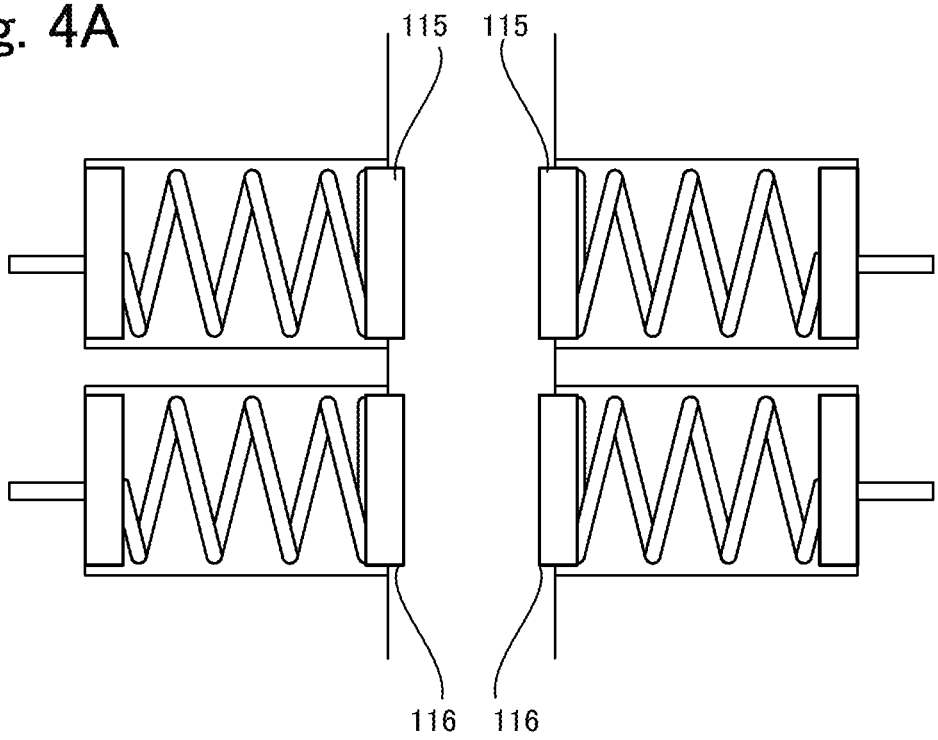
FIG. 4A and FIG. 4B are schematic cross-sectional diagrams showing a connection mode of a ground terminal and a power terminal.
Figure 4B:
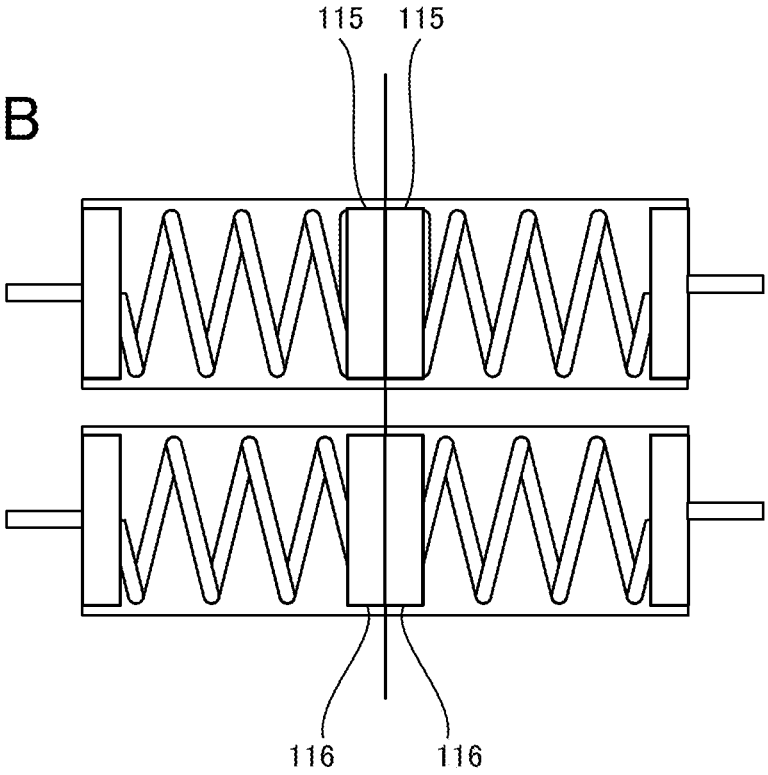

As shown in partial cross-sectional views of FIG. 4A and FIG. 4B, the ground terminal 115 and the power terminal 116 are plate-like members and project slightly further than a peripheral portion (a member 10*c*). The ground terminal 115 and the power terminal 116, inside the first connector 11, are connected to a spring made of a conductive member. Accordingly, when the first connector 11 is connected to another connector (the second connector 12 of another connection cable 1, for example), the ground terminal 115 is to be electrically connected appropriately to the ground terminal 115 while the power terminal 116 is to be electrically connected appropriately to the power terminal 116.

In such a manner, the first connector 11 is a hermaphroditic connector in which, across the predetermined reference line K1 in a plan view, the right side is a female side and the left side is a male side. Therefore, the first connector 11 is able to be connected to a first connector 11 of another connection cable 1 or to a second connector 12 of another connection cable 1.

Then, as shown in FIG. 2B, the male terminal 111A of the first connector 11 is connected to the female terminal 112A of the second connector 12 by internal wiring, the male terminal 111B of the first connector 11 is connected to the male terminal 111B of the second connector 12, the female terminal 112A of the first connector 11 is connected to the male terminal 111A of the second connector 12, and the female terminal 112B of the first connector 11 is connected to the female terminal 112B of the second connector 12.

In addition, the ground terminal 115 of the first connector 11 is connected to the ground terminal 115 of the second connector 12, and the power terminal 116 of the first connector 11 is connected to the power terminal 116 of the second connector 12. A signal line (a ground wire and a power wire in the present preferred embodiment) to be connected to the ground terminal 115 and the power terminal 116 is connected to the base plate 70. Accordingly, electric power is supplied to the DSP 701.

The signal line connected to the male terminal 111B of the first connector 11 and the male terminal 111B of the second connector 12 is connected to the DSP 701. The DSP 701 inputs the sound pickup signal that has been generated by the microphone unit 50, and performs various types of signal processing.

Figure 5A:
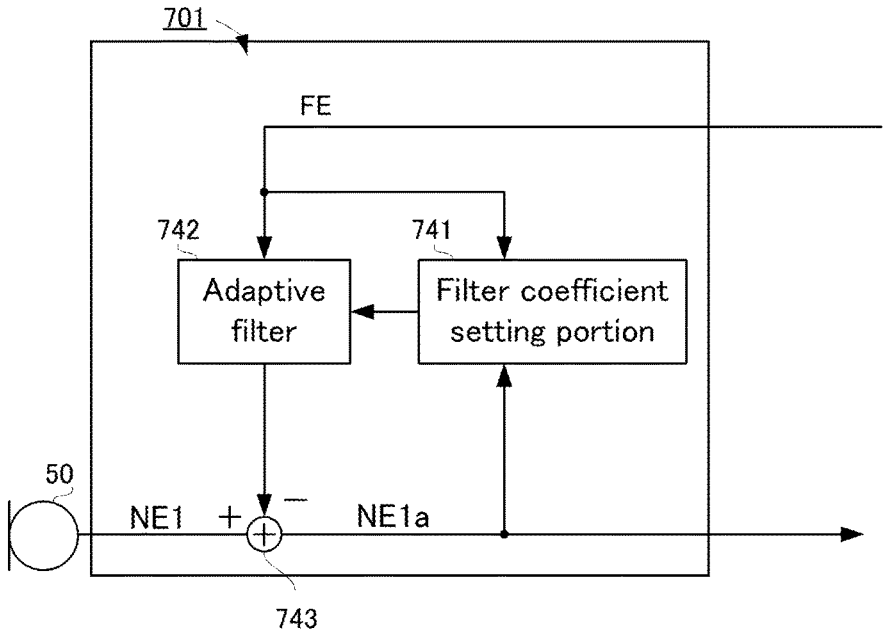
FIG. 5A is a block diagram showing a functional configuration of a DSP.

The DSP 701, for example, functions as an echo canceller that removes an echo component from the sound that has been picked up by the microphone unit 50. The echo canceller will be described with reference to FIG. 5A. As shown in FIG. 5A, the DSP 701 is functionally configured by a filter coefficient setting portion 741, an adaptive filter 742, and an addition portion 743.

The filter coefficient setting portion 741 estimates a transfer function of an acoustic transmission system (an acoustic propagation path from the speaker of the host device 2 to the microphone of the microphone unit 50) and sets a filter coefficient of the adaptive filter 742 using the estimated transfer function.

The adaptive filter 742 is made of an FIR filter, for example. The adaptive filter 742, from the host device 2, inputs a radiation sound signal FE to be input to a speaker 104 (see FIG. 5B) of the host device 2, and performs filtering using the filter coefficient set in the filter coefficient setting portion 741 and generates a pseudo-regression sound signal. The adaptive filter 742 outputs the generated pseudo-regression sound signal to the addition portion 743.

The addition portion 743 subtracts the pseudo-regression sound signal that has been input from the adaptive filter 742, from the sound pickup signal NE1, and outputs a sound pickup signal NE1*a*.

The filter coefficient setting portion 741, on the basis of the sound pickup signal NE1*a* that has been output from the addition portion 743 and the radiation sound signal FE, updates the filter coefficient using an adaptive algorithm such as an LMS (Least Means Square) algorithm. Then, the filter coefficient setting portion 741 sets the updated filter coefficient to the adaptive filter 742.

The sound pickup signal NE1*a* that has been subjected to the signal processing in the DSP 701 is output to the signal line connected to the female terminal 112B of the first connector 11 and the female terminal 112B of the second connector 12.

Figure 5B:
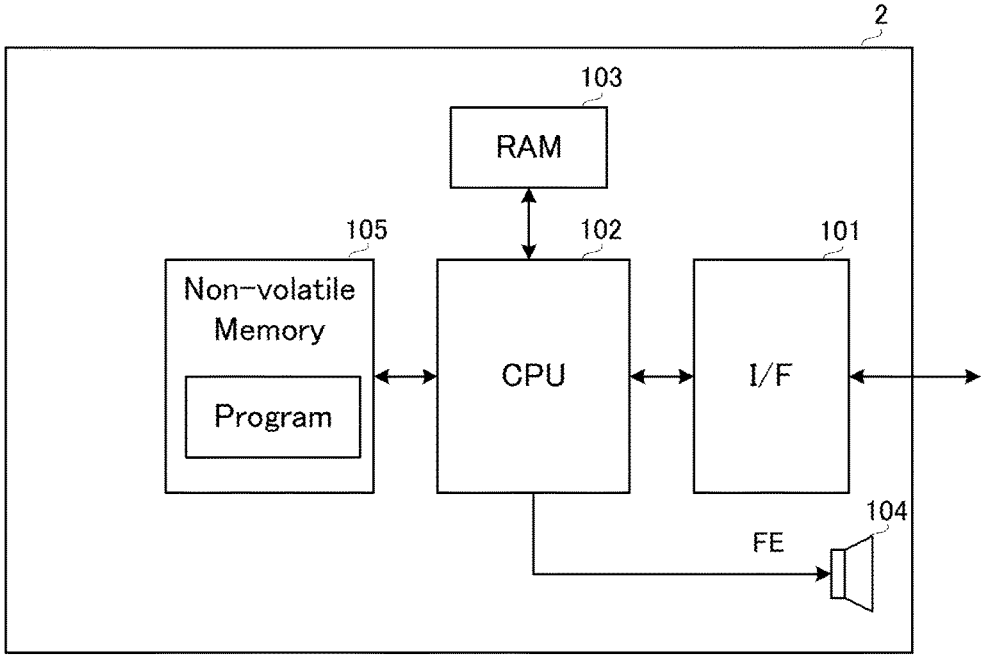
FIG. 5B is a block diagram showing a configuration of a host device.

It is to be noted that the function of the DSP 701 is not limited to an echo canceller. A non-volatile memory 105 of the host device 2 additionally stores, for example, a program for making the DSP 701 achieve the function of a noise canceller. The host device 2, as shown in FIG. 5B, is provided with an I/F 101, a CPU 102, a RAM 103, a speaker 104, and a non-volatile memory 105.

The I/F 101 includes an interface that has the same structure as the first connector 11. The I/F 101 further includes a network interface for communicating with other devices.

The CPU 102 reads programs from the non-volatile memory 105, and stores the program in the RAM 103 temporarily and performs various operations. For example, the CPU 102 inputs a sound pickup signal from the microphone unit 50 of each connection cable 1, and transmits the sound pickup signal to another host device 2 connected through a network. In addition, the CPU 102 receives the sound pickup signal from another host device 2 connected through the network, and makes the sound pickup signal emitted from the speaker 104. Accordingly, the signal processing system 10 including the host device 2 functions as an audio conferencing system.

The non-volatile memory 105 includes a flash memory, an HDD, or an SSD. The non-volatile memory 105 stores an operating program of the DSP 701 in each connection cable 1. The CPU 102 reads the predetermined operating program from the non-volatile memory 105, and transmits the program to the DSP of each connection cable 1 through the I/F 101. The signal according to the operating program, through wiring for receiving a sound pickup signal, is transmitted by AM modulation, for example.

Figure 3:
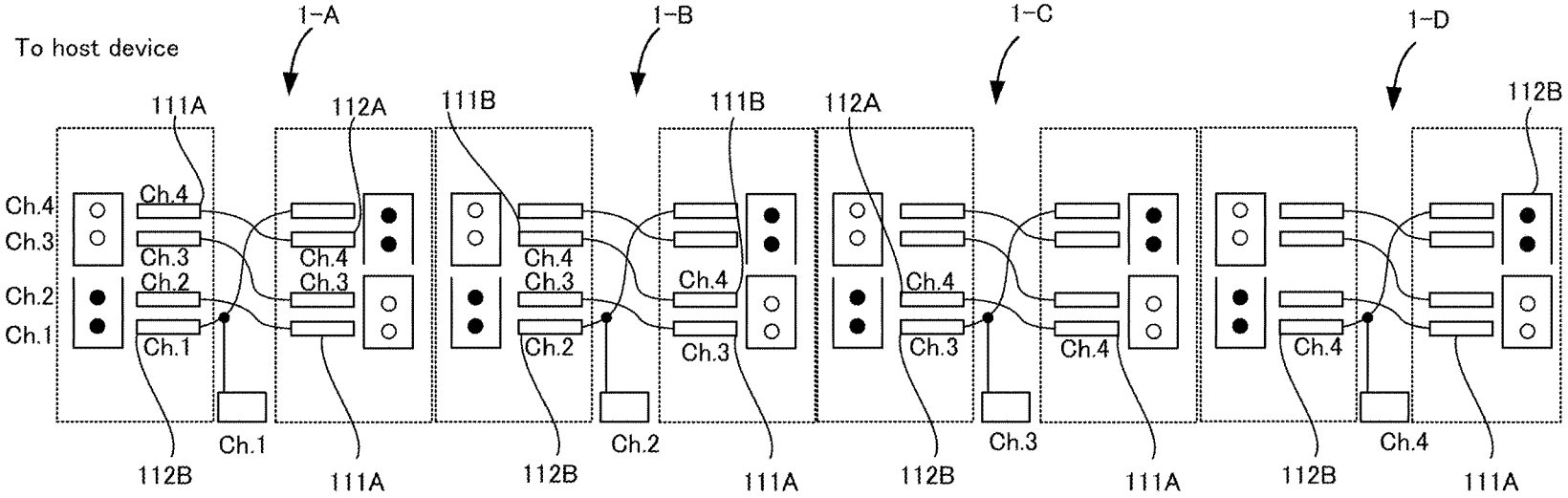
FIG. 3 is a diagram schematically showing a flow of a signal.

Subsequently, FIG. 3 is a diagram schematically showing a flow of a signal in the signal processing system 10. In FIG. 3, for convenience, the connection cable 1 connected to the host device 2 is referred to as a connection cable 1-A, and the other connection cables 1 are referred to as a connection cable 1-B, a connection cable 1-C, and a connection cable 1-D, respectively, in order away from the host device 2. In addition, the sound pickup signal picked up from the microphone of the connection cable 1-A is referred to as a channel 1 (Ch. 1), and, in order, the sound pickup signal picked up from the microphone of the connection cable 1-B is referred to as a channel 2 (Ch. 2), the sound pickup signal picked up from the microphone of the connection cable 1-C is referred to as a channel 3 (Ch. 3), and the sound pickup signal picked up from the microphone of the connection cable 1-D is referred to as a channel 4 (Ch. 4).

As described above, the microphone unit 50 of each connection cable 1 is connected to the female terminal 112B of the first connector 11 and the female terminal 112B of the second connector 12 through the DSP 701. For example, the sound pickup signal of Ch. 4 is output from the female terminal 112B.

Then, when the first connector 11 or the second connector 12 of the connection cable 1-D is connected to the first connector 11 or the second connector 12 of the connection cable 1-C, the female terminal 112B of the connection cable 1-D is connected to the male terminal 111A of the connection cable 1-C. Accordingly, for example, the sound pickup signal of Ch. 4 is transmitted to the male terminal 111A of the connection cable 1-C. The male terminal 111A, inside of the connection cable 1, is connected to the female terminal 112A with the same signal line. Thus, the sound pickup signal of Ch. 4 is transmitted to the female terminal 112A of the connection cable 1-C.

Further, the female terminal 112A of the connection cable 1-C is connected to the male terminal 111B of the connection cable 1-B. Thus, the sound pickup signal of Ch. 4 is transmitted to the male terminal 111B of the connection cable 1-B. Then, the male terminal 111B of the connection cable 1-B is connected to the female terminal 112A of the connection cable 1-A. Thus, the sound pickup signal of Ch. 4 is transmitted to the male terminal 111A of the connection cable 1-A. Eventually, the sound pickup signal of Ch. 4 is transmitted to the host device 2 through one signal terminal (a female terminal) among the connectors provided at the host device 2.

Similarly, the sound pickup signal of Ch. 3, the sound pickup signal of Ch. 2, and the sound pickup signal of Ch. 1 are also transmitted to the host device 2 through respective separate signal terminals.

In this manner, according to the connection cable 1 disclosed in the present preferred embodiment, the first connector 11 and the second connector 12 have the same structure, so that, in any connection cable 1, it is unnecessary to care about the direction of connection. Then, the sound pickup signal generated by the microphone unit 50 in each connection cable 1 is transmitted up to the host device 2 without being mixed with the sound pickup signal generated by the microphone unit 50 in the other connection cables 1. Therefore, even without using the system of switching an input port and an output port, a unit built-in connection cable 1 with which a user does not have to be conscious of whether the port is an input port or an output port or how units are to be connected is able to be achieved.

Figure 6A:
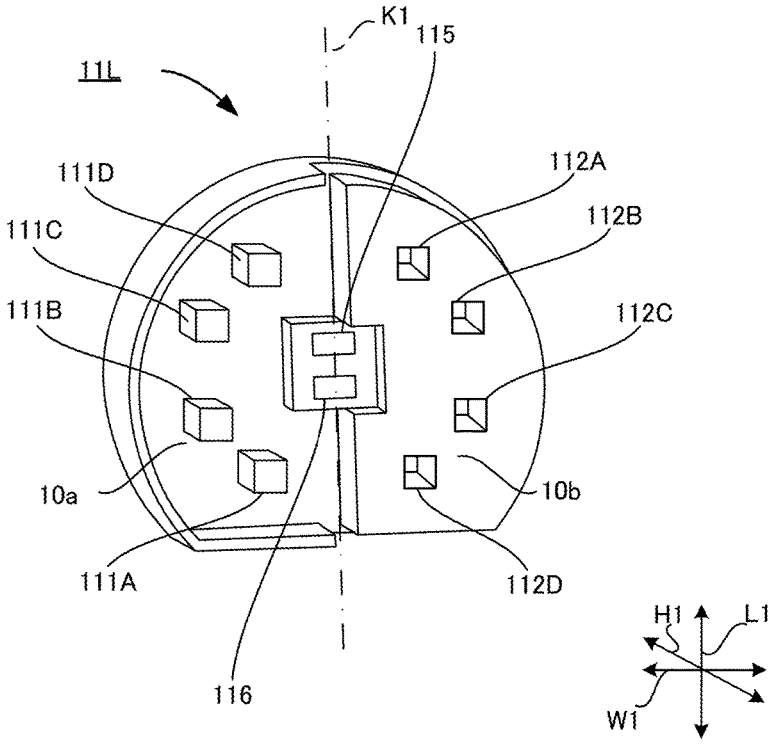
FIG. 6A is a diagram showing a structure of a connector according to a first modification example.
Figure 6B:
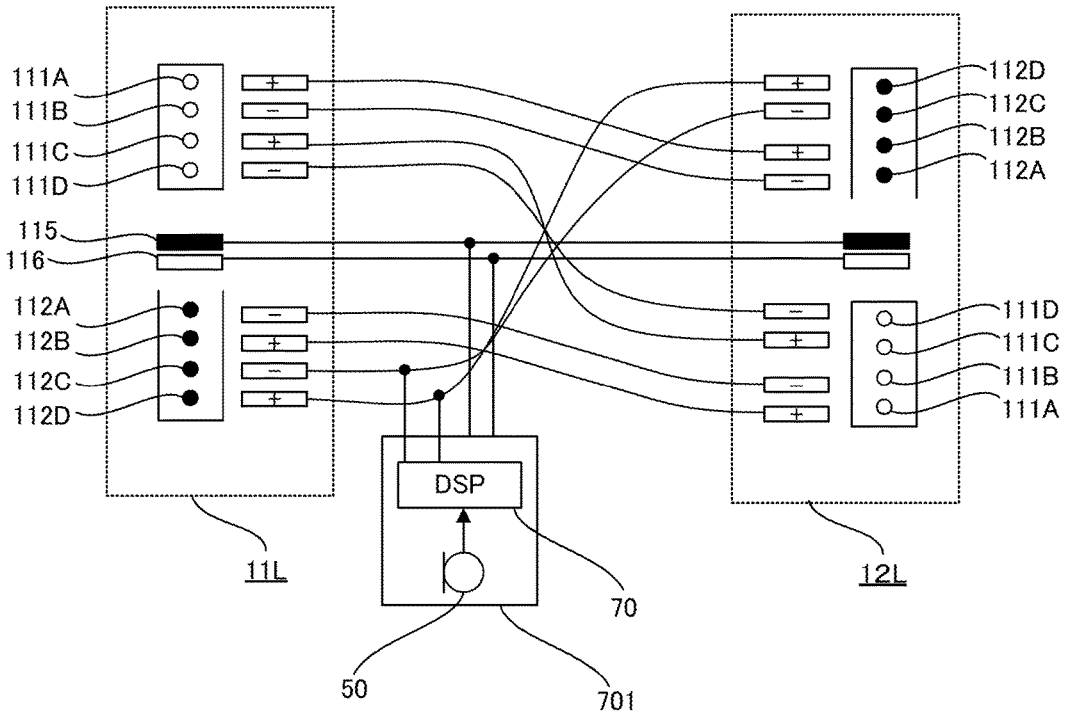
FIG. 6B is an internal wiring diagram and a configuration block diagram.

Subsequently, FIG. 6A is a diagram showing a structure of a connector (a first connector 11L and a second connector 12L) according to a first modification example, and FIG. 6B is an internal wiring diagram and a configuration block diagram. The basic structure of the first connector 11L and the second connector 12L according to the first modification example is the same as the basic structure of the first connector 11 and the second connector 12.

However, in the first connector 11L and the second connector 12L, the number of male terminals and female terminals increases, and four male terminals and four female terminals are provided at each of the first connector 11L and the second connector 12L. In other words, a male terminal 111C, a male terminal 111D, a female terminal 112C, and a female terminal 112D are additionally provided.

The male terminal 111A, the male terminal 111B, the male terminal 111C, and the male terminal 111D are arranged on the left side (the first side) with respect to the predetermined reference line K1 in a plan view of the bottom surface 10*a* or bottom surface 10*b* of the first connector 11L. The female terminal 112A, the female terminal 112B, the female terminal 112C, and the female terminal 112D are arranged on the right side (the second side) with respect to the predetermined reference line K1 in a plan view of the bottom surface 10*a* or bottom surface 10*b* of the first connector 11L. The male terminal 111A, the male terminal 111B, the male terminal 111C, and the male terminal 111D are respectively arranged bilaterally symmetrical to the female terminal 112A, the female terminal 112B, the female terminal 112C, and the female terminal 112D across the predetermined reference line K1.

Then, as shown in FIG. 6B, the male terminal 111A of the first connector 11L is connected to the female terminal 112B of the second connector 12L, the male terminal 111B of the first connector 11L is connected to the female terminal 112A of the second connector 12L, the male terminal 111C of the first connector 11L is connected to the male terminal 111C of the second connector 12L, and the male terminal 111D of the first connector 11L is connected to the male terminal 111D of the second connector 12L. The female terminal 112A of the first connector 11L is connected to the male terminal 111B of the second connector 12L, the female terminal 112B of the first connector 11L is connected to the male terminal 111A of the second connector 12L, the female terminal 112C of the first connector 11L is connected to the female terminal 112C of the second connector 12L, and the female terminal 112D of the first connector 11L is connected to the female terminal 112D of the second connector 12L.

The first connector 11L and the second connector 12L are each a connector for transmitting a differential signal. For example, the male terminal 111A and the male terminal 111B are one pair, the male terminal 111A and the female terminal 112B are each a terminal for transmitting positive voltage, and the male terminal 111B and the female terminal 112A are each a terminal for transmitting negative voltage. When the two terminals for transmitting the differential signals are considered as one pair, the flow of signals is the same as the flow shown in FIG. 3. In this manner, even when a differential signal is transmitted, the connection cable 1 of the present invention is able to be applied.

Figure 7A:
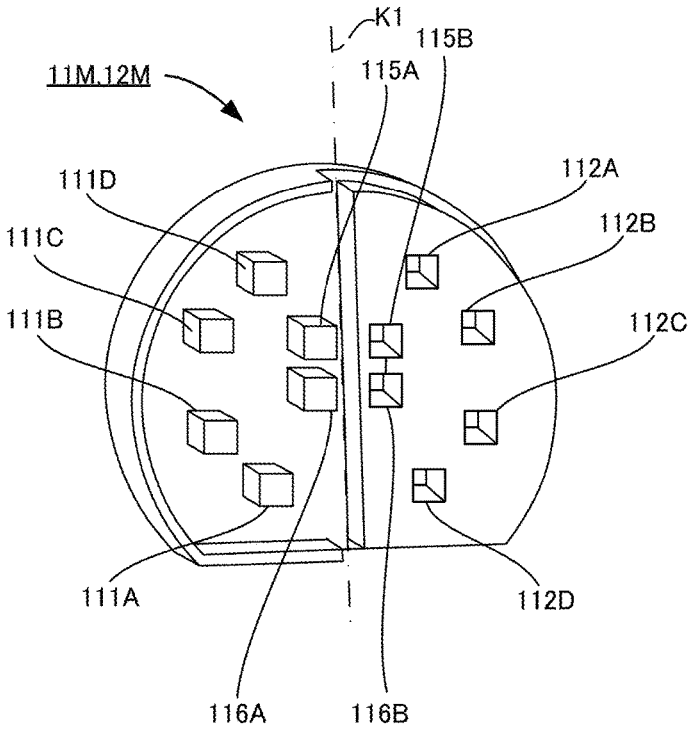
FIG. 7A is a diagram showing a structure of a connector according to a second modification example.
Figure 7B:
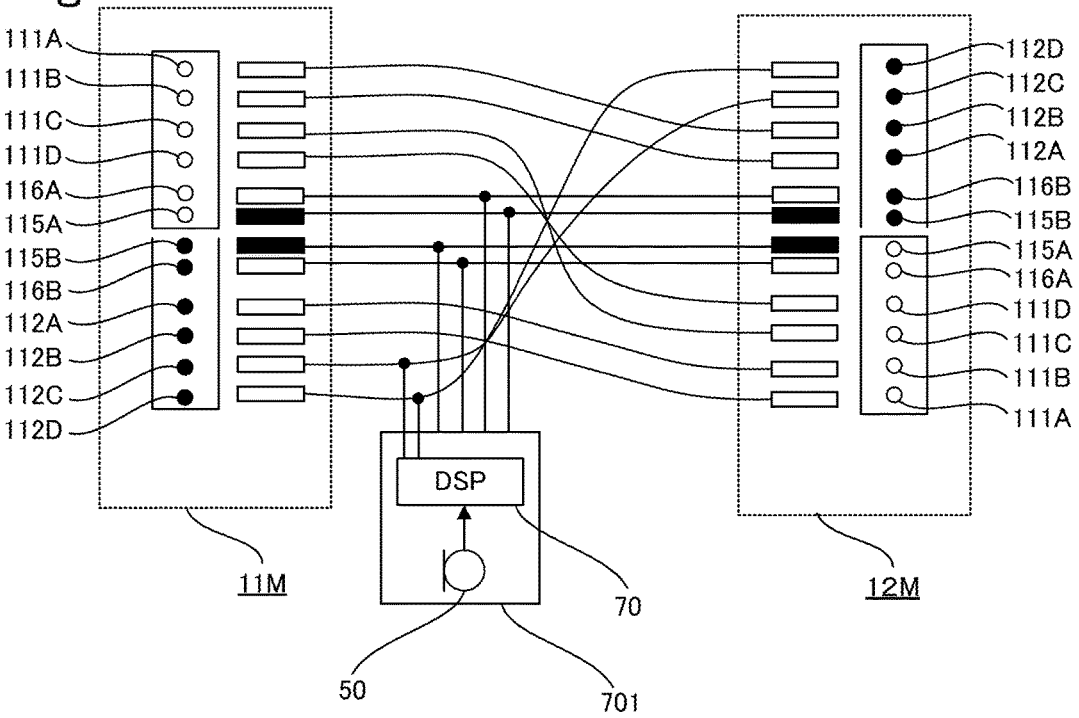
FIG. 7B is an internal wiring diagram and a configuration block diagram.

Subsequently, FIG. 7A is a diagram showing a structure of a connector (a first connector 11M and a second connector 12M) according to a second modification example, and FIG. 7B is an internal wiring diagram and a configuration block diagram. The first connector 11M and the second connector 12M according to the second modification example are provided with a ground terminal 115A, a ground terminal 115B, a power terminal 116A, and a power terminal 116B. The ground terminal 115A and the ground terminal 115B are arranged bilaterally symmetrical to each other across the predetermined reference line K1. The power terminal 116A and the power terminal 116B are also arranged bilaterally symmetrical to each other across the predetermined reference line K1. The configuration other than the ground terminals 115A and 115B and the power terminals 116A and 116B is the same as the configuration of the first connector 11L and the second connector 12L according to the second modification example.

The ground terminal 115A and the power terminal 116A are convex-shaped structures. In addition, the ground terminal 115B and the power terminal 116B are concave-shaped structures. The ground terminal 115A is formed so as to be inserted to the ground terminal 115B. Similarly, the power terminal 116A is formed so as to be inserted to the power terminal 116B.

In this manner, the ground terminals 115A and 115B and the power terminals 116A and 116B do not need to be arranged on the predetermined reference line K1, and, similarly to the signal terminals, may be arranged in line symmetry across the predetermined reference line K1.

Figure 8B:
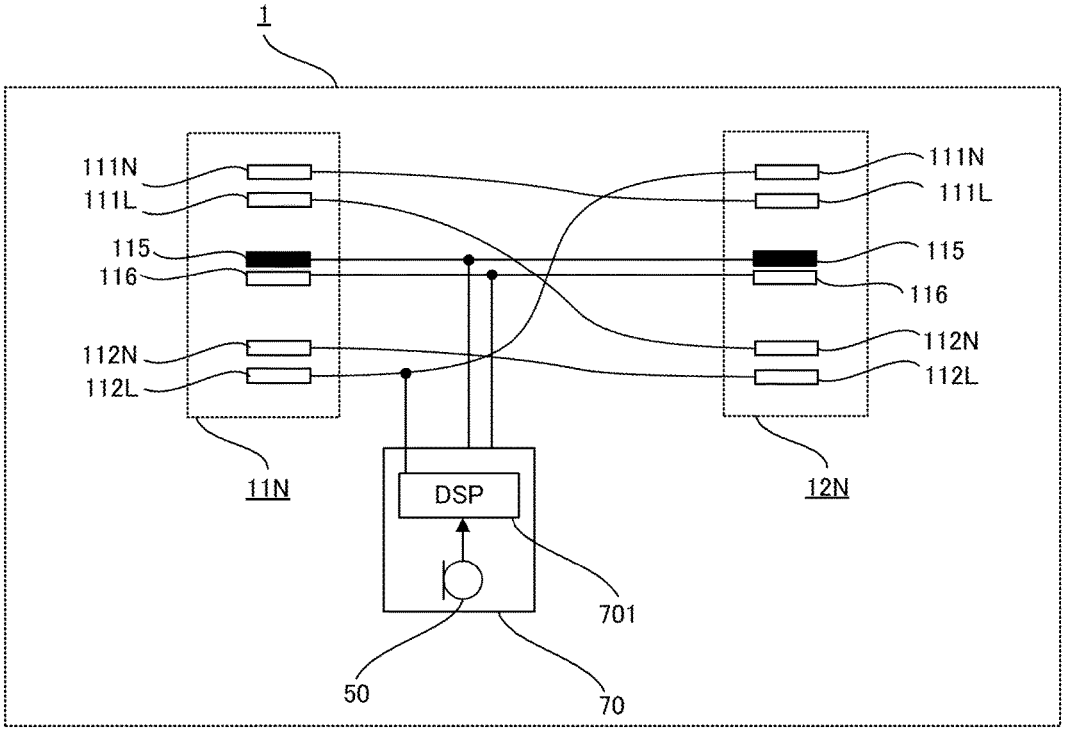
FIG. 8B is an internal wiring diagram and a configuration block diagram.

It is to be noted that the configuration of arranging in line symmetry across the predetermined reference line K1 is not limited to a signal terminal (the male terminal 111A, the male terminal 111B, the male terminal 111C, the male terminal 111D, the female terminal 112A, the female terminal 112B, the female terminal 112C, and the female terminal 112D, for example), a ground terminal (the ground terminal 115A and the ground terminal 115B, for example), and a power terminal (the power terminal 116A and the power terminal 116B, for example). When a connector (the first connector 11M or the second connector 12M, for example) is provided with a plurality of structures and includes a mode in which a concave-shaped structure and a convex-shaped structure are arranged in line symmetry across the predetermined reference line K1, the connector is included in the range of the present invention. For example, the first connector 11N (the second connector 12N) according to the third modification example shown in FIG. 8A and FIG. 8B is provided with a convex portion 171 and a concave portion 172 that are arranged in line symmetry across the predetermined reference line K1. The convex portion 171 and the concave portion 172 may be integrally formed with the first connector 11N (the second connector 12N) that is made of a resin material, for example.

Then, the first connector 11N (the second connector 12N) is provided with a ground terminal 115, a power terminal 116, a signal terminal 111N, a signal terminal 111L, a signal terminal 112N, and a signal terminal 112L on the predetermined reference line K1.

The signal terminal 111N corresponds to the male terminal 111A of the example shown in FIG. 2A and FIG. 2B. The signal terminal 111L corresponds to the male terminal 111B of the example shown in FIG. 2A and FIG. 2B. The signal terminal 112N corresponds to the female terminal 112A of the example shown in FIG. 2A and FIG. 2B. The signal terminal 112L corresponds to the female terminal 112B of the example shown in FIG. 2A and FIG. 2B.

In such a configuration as well, the sound pickup signal that has been generated in the microphone unit 50 in each connection cable 1 is transmitted up to the host device 2 without being mixed with a sound pickup signal that has been generated in the microphone unit 50 in the other connection cables 1.

Figure 9:
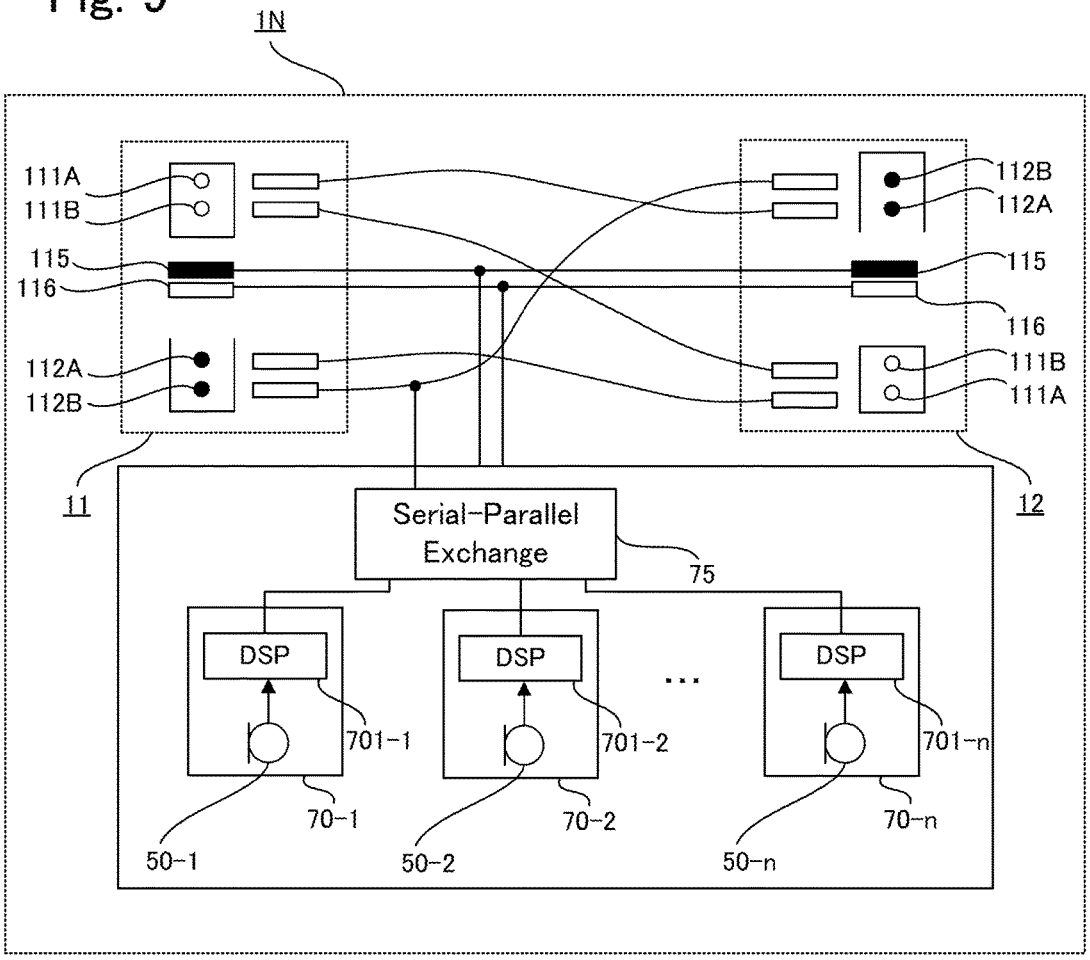
FIG. 9 is an internal wiring diagram and configuration block diagram of a connection cable according to a fourth modification example.

Subsequently, FIG. 9 is an internal wiring diagram and configuration block diagram of a connection cable 1N according to a fourth modification example. The connection cable 1N is provided with a plurality of microphone units (a microphone unit 50-1, a microphone unit 50-2, . . . a microphone unit 50-*n*), DSPs (a DSP 701-1, a DSP 701-2, . . . a DSP 701-*n*) (a signal processor) to be connected to each microphone, and base plates (a base plate 70-1, a base plate 70-2, . . . a base plate 70-*n*) on which the DSP is mounted. In addition, the connection cable 1N is provided with converter (serial-parallel exchanger) 75 that outputs a sound pickup signal (an output signal) (parallel data) that has been output from each DSP as serial data. In addition, the converter 75 inputs the data (serial data) to be transmitted from the host device 2, and supplies the data to each DSP as parallel data. For example, the host device 2 reads a program, which transmits to each DSP, to be divided into the desired units bit data from the non-volatile memory 105. And, the host device 2 creates serial data in which is arranged the desired unit bit data in order of being received by each DSP. The converter 75 extracts the first unit bit data from unit bit data that has been input, and inputs the first unit bit data into the DSP 701-1. The second unit bit data is input into the DSP 701-2, and the n-th unit bit data is input into the DSP 701-*n*.

In addition, according to the configuration, the host device 2 is also able to obtain a positional relationship between each microphone unit 50 in the connection cable 1N and the host device 2. To begin with, the CPU 102 of the host device 2 outputs a test sound from the speaker 104. The test sound uses white noise, for example. Each microphone unit 50 in the connection cable 1N outputs a sound pickup signal according to the test sound. The sound pickup signal according to the test sound is transmitted to the host device 2. The host device 2 estimates distance with each microphone unit 50 on the basis of a time difference between the output of the test sound from the speaker 104 and the reception of the sound pickup signal from each microphone unit 50. In addition, the host device 2 is also able to estimate a transfer function (impulse response) of an acoustic transmission system from the sound pickup signal. The estimated transfer function is transmitted to each DSP and set up as a filter coefficient of an FIR filter. In addition, according to the distance of each microphone unit 50, the tap length of the FIR filter is able to be changed. In this manner, the host device 2 is able to determine signal processing content of each microphone on the basis of the signal that has been received from each microphone.

Figure 10A:
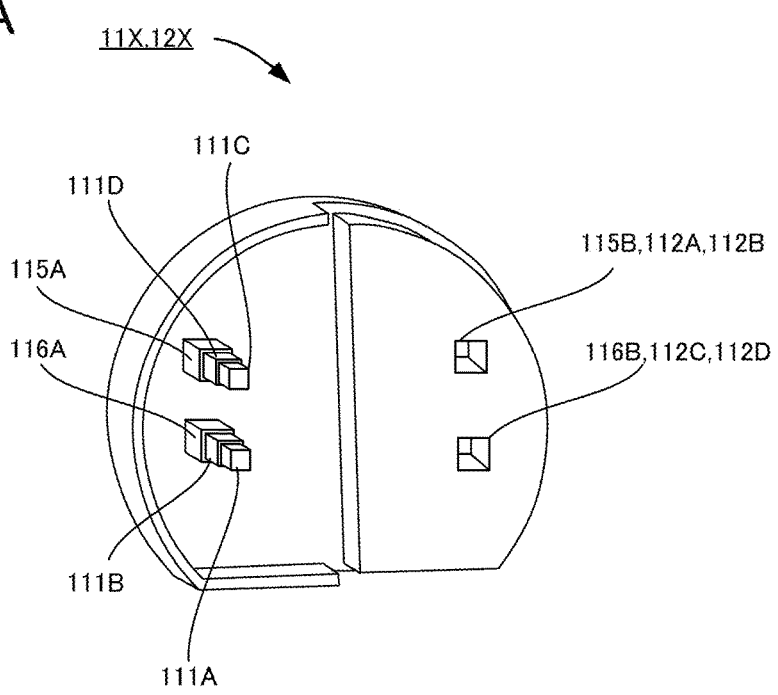
FIG. 10A is a diagram showing a structure of a connector according to a fifth modification example.
Figure 10B:
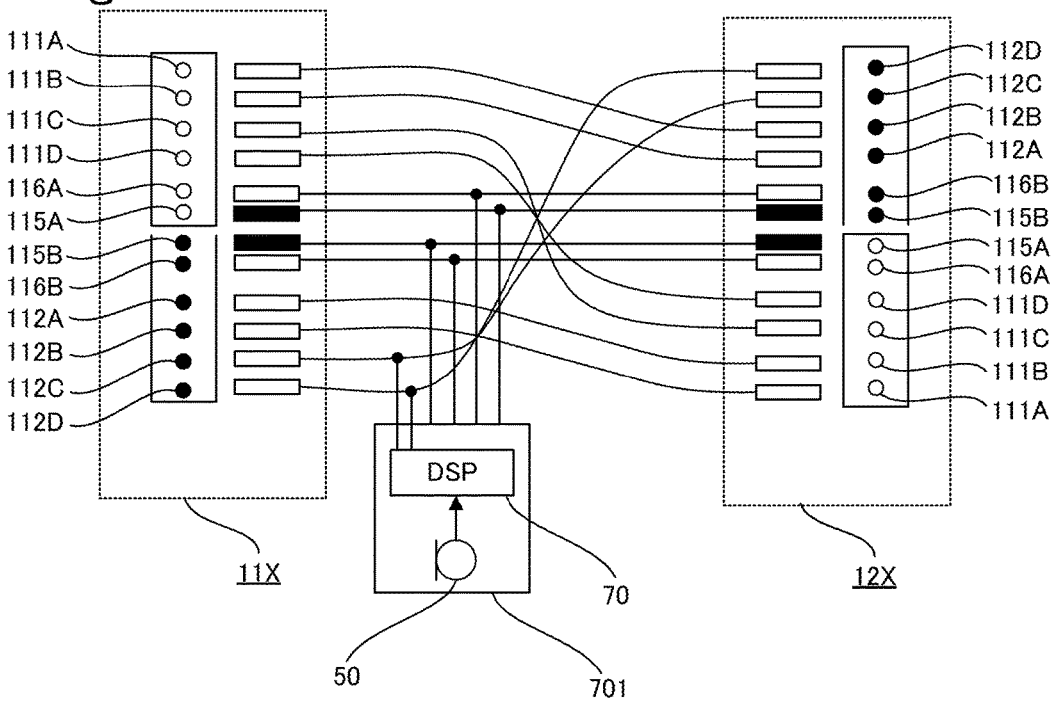
FIG. 10B is an internal wiring diagram and a configuration block diagram.

Subsequently, FIG. 10A is a diagram showing a structure of a connector (a first connector 11X and a second connector 12X) according to a fifth modification example, and FIG. 10B is an internal wiring diagram and a configuration block diagram. The first connector 11X (the second connector 12X) according to the fifth modification example has a feature that a multi-pole terminal is used. The internal wiring and configuration are the same as the internal wiring and configuration of the first connector 11M (the second connector 12M) shown in FIG. 7A and FIG. 7B. In the first connector 11X (the second connector 12X), the power terminal 116A, the male terminal 111A, and the male terminal 111B are integrated into one multi-pole terminal. In addition, the ground terminal 115A, the male terminal 111C, and the male terminal 111D are integrated into one multi-pole terminal; the ground terminal 115B, the female terminal 112A, and the female terminal 112B are integrated into one multi-pole terminal; and the power terminal 116B, the female terminal 112C, and the female terminal 112D are integrated into one multi-pole terminal. As a result, the number of terminals decreases, as compared with the number of terminals of the first connector 11M (the second connector 12M) shown in FIG. 7A and FIG. 7B.

It is to be noted that the number of poles of a terminal is not limited to this example. The terminal may be a bipolar terminal or also may be a terminal provided with the large numbers of poles. In addition, the function allocated to each pole is not limited to this example. For example, in a bipolar terminal, the male terminal 111A and the male terminal 111B may be integrated into one terminal.

Figure 11A:
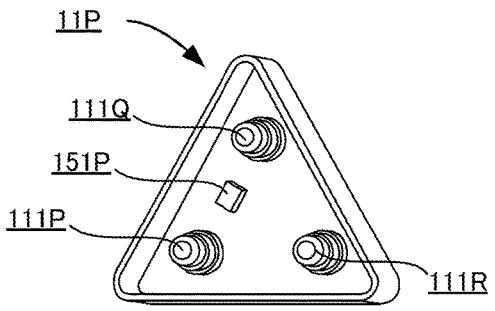
FIG. 11A is a diagram showing a structure of a first connector according to a sixth modification example.
Figure 11B:
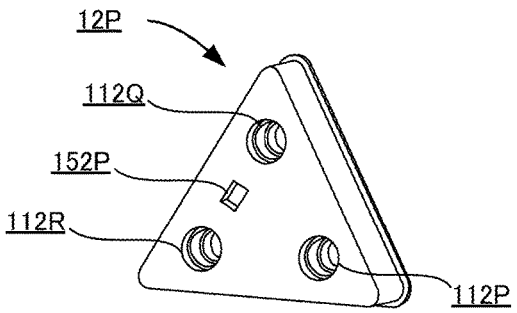
FIG. 11B is a diagram showing a structure of a second connector according to the sixth modification example.
Figure 11C:
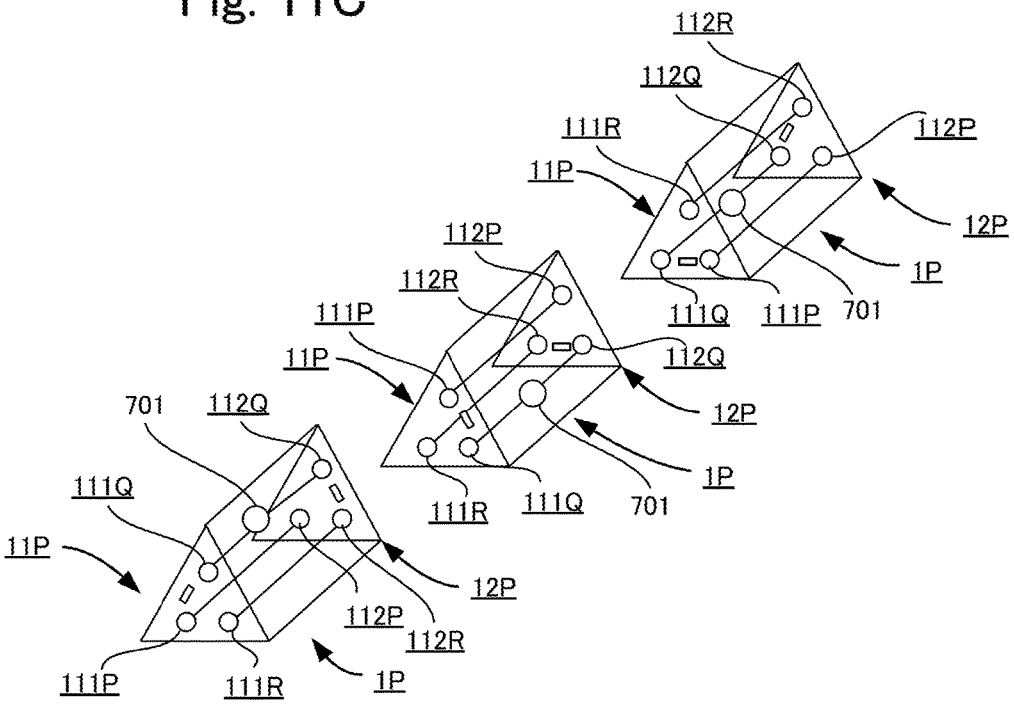
FIG. 11C is a diagram showing wiring between connection cables.

Subsequently, FIG. 11A and FIG. 11B are each a diagram showing a structure of a connector (a first connector 11P and a second connector 12P) according to a sixth modification example, and FIG. 11C is a diagram showing wiring between connection cables.

The first connector 11P is provided with three male terminals of a male terminal 111P, a male terminal 111Q, and a male terminal 111R, and a convex portion 151P. The second connector 12P is provided with three female terminals of a female terminal 112P, a female terminal 112Q, and a female terminal 112R, and a concave portion 152P.

The first connector 11P and the second connector 12P each have the shape of a triangle in a plan view, and each terminal is provided at each apex of the triangle. However, the shape in a plan view is not limited to a triangle. In addition, the number of terminals is not limited to this example.

Between the male terminal 111Q and the female terminal 112Q, a DSP 701 is provided and a not-shown microphone unit 50 is connected to the male terminal 111Q and the female terminal 112Q through the DSP 701. The male terminal 111P and the female terminal 112P are connected by internal wiring, and the male terminal 111R and the female terminal 112R are connected by internal wiring.

The convex portion 151P is arranged between the male terminal 111P and the male terminal 111Q. The concave portion 152P is arranged between the female terminal 112Q and the female terminal 112R. Therefore, as shown in FIG. 11C, when the first connector 11P of one connection cable 1P and the second connector 12P of another connection cable 1P are connected so that the convex portion 151P and the concave portion 152P may be fitted in each other, the male terminal 111P and the female terminal 112Q are connected, the male terminal 111Q and the female terminal 112R are connected, and the male terminal 111R and the female terminal 112P are connected.

As described above, the connection cable 1P according to the sixth modification example is provided with: the first connector 11P provided with the male terminals 111P, 111Q, and 111R; the second connector 12P provided with the female terminals 112P, 112Q, and 112R; the convex-shaped structure (the convex portion 151P) provided in one of the first connector 11P or the second connector 12P; and the concave-shaped structure (the concave portion 152P) provided in the other of the first connector 11P or the second connector 12P, and the convex-shaped structure and the concave-shaped structure are arranged at positions different from each other with respect to a terminal to be connected by the same signal line.

Therefore, similarly to the connection cable 1 shown in FIG. 1A and FIG. 1C, the sound pickup signal to be output from the DSP 701 of each connection cable is transmitted up to the host device 2 without being mixed with a sound pickup signal to be output from a DSP 701 in another connection cable. Therefore, even without using the system of switching an input port and an output port, a connection cable 1 with which a user does not have to be conscious of whether the port is an input port or an output port is able to be achieved.

Figure 12A:
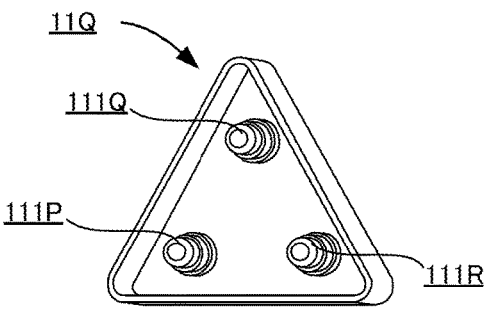
FIG. 12A is a diagram showing a structure of a first connector of an extension cable.
Figure 12B:
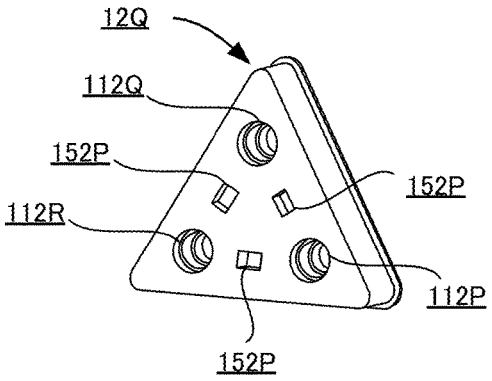
FIG. 12B is a diagram showing a structure of a second connector of the extension cable.
Figure 12C:
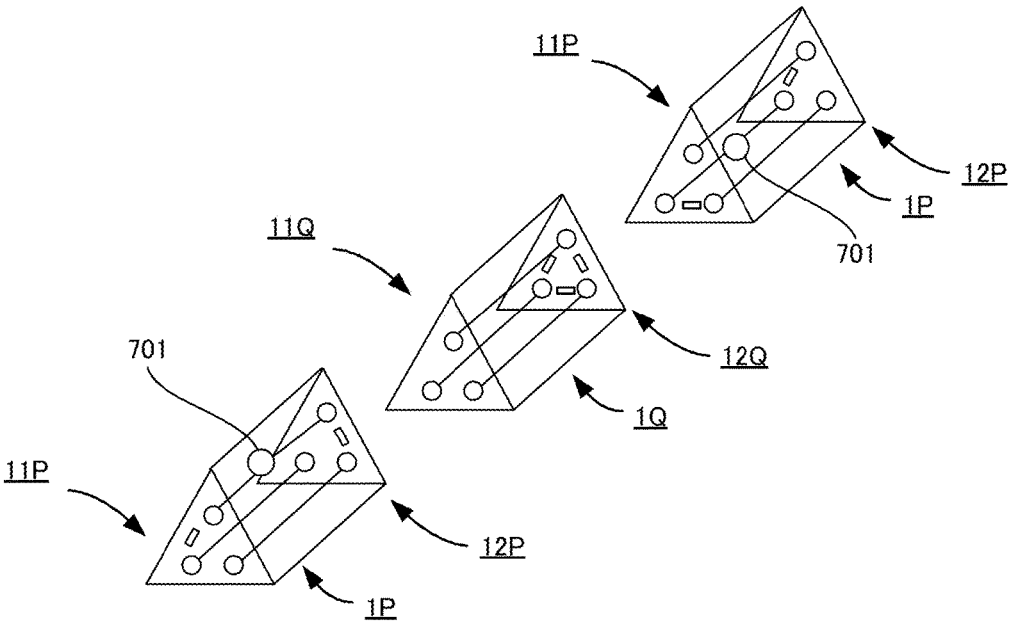
FIG. 12C is a diagram showing a structure of wiring between the connection cables.

FIG. 12A and FIG. 12B are diagrams showing a structure of a connector of an extension cable 1Q, and FIG. 12C is a diagram showing wiring between the connection cables 1P. While a first connector 11Q and a second connector 12Q of the extension cable 1Q each have the same structure as the first connector 11P and the second connector 12P, the first connector 11Q is not provided with a convex portion. In addition, the second connector 12Q includes a concave portion 152P between all the female terminals 112P, 112Q, and 112R. Moreover, the extension cable 1Q is not provided with a microphone unit 50 or a DSP 701.

Therefore, as shown in FIG. 12C, the extension cable 1Q is connectable to another connection cable 1P in whichever direction the extension cable 1Q is oriented. In addition, a sound pickup signal that has been input from another connection cable 1P is only directly transmitted to another side.

It is to be noted that, while, in the present preferred embodiment, all the examples describe the microphone built-in type connection cable (the microphone), a speaker may be provided instead of the microphone, for example. In addition, a sensor (a human body sensor, for example) may be provided instead of the microphone. Alternatively, a lighting function such as an LED may be provided instead of the microphone.

In addition, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A connection cable comprising:

a plurality of connectors, including a first connector and a second connector, each comprising:

a first signal terminal including a plurality of female terminals each with a concave-shaped structure; and a second signal terminal including a plurality of male terminals each with a convex-shaped structure;

signal lines connecting the first signal terminal and the second signal terminal, and comprising:

a first signal line connecting one terminal, among the plurality of male terminals of the first or second signal terminal, and one terminal, among the plurality of female terminals of the second or first signal terminal; and a second signal line connecting another terminal, among the plurality of male or female terminals of the first signal terminal, and another terminal, among the plurality of male or female terminals of the second signal terminal, wherein the first signal terminal and the second signal terminal are arranged in line symmetry with respect to a predetermined reference line.

2. The connection cable according to claim 1, wherein at least one of the first or second signal line is arranged at positions different from each other in the first connector and the second connector.

3. The connection cable according to claim 1, further comprising:
a power wire; and
a ground wire,
wherein each of the first and second connectors further include:
a power terminal connected to the power wire;
a ground terminal connected to the ground wire,
wherein the power terminal and the ground terminal are arranged on the predetermined reference line.

4. The connection cable according to claim 1, further comprising:
a power wire; and
a ground wire,
wherein each of the first and second connectors further include:
a power terminal connected to the power wire;
a ground terminal connected to the ground wire,
wherein the power terminal and the ground terminal are arranged in line symmetry with respect to the predetermined reference line.

5. The connection cable according to claim 1, wherein at least one of the first or second signal terminal includes a multi-pole terminal.

6. The connection cable according to claim 1, wherein at least one of the first or second connector includes a flat surface.

7. The connection cable according to claim 1, wherein the first connector and the second connector each have a different height across the predetermined reference line.

8. The connection cable according to claim 1, wherein each of the male and female terminals is integrally formed with the first connector or the second connector.

9. The connection cable according to claim 1, wherein the predetermined reference line is a straight line passing a center in a width direction of the first connector or the second connector.

10. A microphone comprising:
a connection cable; and
a sound pickup element connected to the connection cable,
wherein the connection cable comprises:
a plurality of connectors, including a first connector and a second connector, each comprising:
a first signal terminal including a plurality of female terminals each with a concave-shaped structure; and
a second signal terminal including a plurality of male terminals each with a convex-shaped structure;
signal lines connecting the first signal terminal and the second signal terminal, and comprising:
a first signal line connecting one terminal, among the plurality of male terminals of the first or second signal terminal, and one terminal, among the plurality of female terminals of the second or first signal terminal; and
a second signal line connecting another terminal, among the plurality of male or female terminals of the first signal terminal, and another terminal, among the plurality of male or female terminals of the second signal terminal,
wherein the first signal terminal and the second signal terminal are arranged in line symmetry with respect to a predetermined reference line.

11. The microphone according to claim 10, wherein the connection cable further includes a holder that holds the sound pickup element.

12. The microphone according to claim 10, further comprising a signal processor configured to process a sound pickup signal that has been obtained by the sound pickup element.

13. The microphone according to claim 12, wherein:
a plurality of sound pickup elements are connected to the connection cable, and
a plurality of signal processors are connected to the plurality of sound pickup elements.

14. The microphone according to claim 13, further comprising:
a converter connected to one of the signal lines in the connection cable,
wherein the converter inputs output signals of the plurality of the signal processors as parallel data, and converts the parallel data into serial data, and outputs the serial data to the one signal line.

15. A signal processing system comprising:
a connection cable;
a microphone comprising a sound pickup element, connected to the connection cable; and
a host device connectable to the connection cable,
wherein the connection cable comprises:
a plurality of connectors, including a first connector and a second connector, each comprising:
a first signal terminal including a plurality of female terminals each with a concave-shaped structure; and
a second signal terminal including a plurality of male terminals each with a convex-shaped structure;
signal lines connecting the first signal terminal and the second signal terminal, and comprising:
a first signal line connecting one terminal, among the plurality of male terminals of the first or second signal terminal, and one terminal, among the plurality of female terminals of the second or first signal terminal; and
a second signal line connecting another terminal, among the plurality of male or female terminals of the first signal terminal, and another terminal, among the plurality of male or female terminals of the second signal terminal,
wherein the first signal terminal and the second signal terminal are arranged in line symmetry with respect to a predetermined reference line.

16. The signal processing system according to claim 15, wherein:
a plurality of microphones are connected to the connection cable;
each of the plurality of microphones transmits a signal to the host device; and
the host device determines signal processing content of each of the plurality of microphones based on the signal that has been received from each of the plurality of microphones.

17. The signal processing system according to claim 16, wherein the host device includes a speaker configured to emit sound based on the signal that has been received from each of the plurality of microphones.

18. The signal processing system according to claim 16, wherein:
each of the plurality of microphones includes a signal processor configured as a filter, and
the host device sets a coefficient of the filter of each of the plurality of microphones.

* * * * *